US012753716B2

(12) United States Patent
Fey

(10) Patent No.: US 12,753,716 B2
(45) Date of Patent: Oct. 6, 2026

(54) METHOD, PROCESSING UNIT, AND COMPUTER PROGRAM FOR ASCERTAINING FILL LEVELS OF A FIRST EXHAUST GAS CATALYTIC CONVERTER AND OF A SECOND EXHAUST GAS CATALYTIC CONVERTER

(71) Applicant: Robert Bosch GmbH, Stuttgart (DE)

(72) Inventor: Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/343,949

(22) Filed: Jun. 29, 2023

(65) Prior Publication Data

US 2024/0011425 A1 Jan. 11, 2024

(30) Foreign Application Priority Data

Jul. 6, 2022 (DE) ..... 10 2022 206 891.2

(51) Int. Cl.
*F01N 11/00* (2006.01)

(52) U.S. Cl.
CPC ..... *F01N 11/007* (2013.01); *F01N 2560/02* (2013.01); *F01N 2900/1624* (2013.01)

(58) Field of Classification Search
CPC ..... F01N 11/007; F01N 2560/02; F01N 2900/1624; F01N 2900/1402; F01N 11/00; F01N 13/0093; F01N 2560/025; F01N 2560/14; F01N 2900/1622
See application file for complete search history.

(56) References Cited

U.S. PATENT DOCUMENTS 6,600,998 B1 * 7/2003 Majima ..... F01N 13/009 702/184
8,333,062 B2 * 12/2012 Sun ..... F01N 3/208 60/303
10,890,093 B2 * 1/2021 Muthukaruppan ..... F01N 11/00
11,085,348 B2 * 8/2021 Fey ..... F02D 41/0295
11,448,112 B2 * 9/2022 Alva ..... F01N 3/021
11,572,821 B2 * 2/2023 Fey ..... F01N 3/0814
(Continued)

FOREIGN PATENT DOCUMENTS

DE 102016222418 A1 5/2018
DE 102018208683 A1 12/2019
DE 102018217307 A1 4/2020

*Primary Examiner* — Matthew T Largi
(74) *Attorney, Agent, or Firm* — Norton Rose Fulbright US LLP

(57) ABSTRACT

A method for ascertaining fill levels of first and second exhaust gas catalytic converters in an exhaust gas system downstream from an internal combustion engine with respect to at least one exhaust gas component. The method includes detecting, using a sensor upstream from the first exhaust gas catalytic converter, at least one operating parameter of the exhaust gas system, ascertaining the fill level of the first exhaust gas catalytic converter based on the detected at least one operating parameter using a first calculation rule, ascertaining a total fill level of the first exhaust gas catalytic converter and second exhaust gas catalytic converter based on the ascertained at least one operating parameter using a second calculation rule, and ascertaining the fill level of the second exhaust gas catalytic converter as a difference between the total fill level and the fill level of the first exhaust gas catalytic converter.

7 Claims, 2 Drawing Sheets

(56) References Cited

U.S. PATENT DOCUMENTS

| | | | | |
|---|---|---|---|---|
| 2002/0157381 | A1* | 10/2002 | Kakuyama | F02D 41/0295 60/276 |
| 2009/0165440 | A1* | 7/2009 | Sawada | F01N 11/007 60/276 |
| 2009/0320454 | A1* | 12/2009 | Sawada | F01N 3/103 60/285 |
| 2015/0337750 | A1* | 11/2015 | Sealy | F02D 41/1455 60/285 |
| 2017/0234199 | A1* | 8/2017 | Sun | F01N 3/035 60/286 |
| 2018/0163589 | A1* | 6/2018 | David | F01N 9/00 |
| 2018/0320571 | A1* | 11/2018 | Fey | F01N 11/007 |
| 2021/0215113 | A1* | 7/2021 | Obuchi | F02D 41/1441 |

* cited by examiner

METHOD, PROCESSING UNIT, AND COMPUTER PROGRAM FOR ASCERTAINING FILL LEVELS OF A FIRST EXHAUST GAS CATALYTIC CONVERTER AND OF A SECOND EXHAUST GAS CATALYTIC CONVERTER

FIELD

The present invention relates to a method for ascertaining fill levels of a first exhaust gas catalytic converter and of a second exhaust gas catalytic converter as well as to a processing unit and to a computer program for carrying out the method.

BACKGROUND INFORMATION

During an incomplete combustion of an air-fuel mixture in a gasoline engine, a plurality of combustion products are emitted, in addition to nitrogen ($N_2$), carbon dioxide ($CO_2$), and water ($H_2O$), of which hydrocarbons (HC), carbon monoxide (CO), and nitrogen oxides ($NO_x$) are limited by law. Typically, it is only possible to adhere to the applicable exhaust gas limits for motor vehicles with the aid of a catalytic exhaust after-treatment. By using a three-way catalytic converter, the described harmful substance components may be converted.

A simultaneously high conversion rate for HC, CO, and NOx is only achieved in three-way catalytic converters in a narrow range around the stoichiometric operating point (lambda=1), the so-called "catalytic converter window."

For operating the catalytic converter in the catalytic converter window, a lambda control is typically employed, which is based on the signals of lambda sensors upstream and downstream from the catalytic converter. For controlling the lambda value upstream from the catalytic converter, the oxygen content of the exhaust gas upstream from the catalytic converter is measured using a lambda sensor. The control unit corrects the fuel amount from the mixture pilot control as a function of this measured value. For a more exact control, the exhaust gas downstream from the catalytic converter is additionally analyzed using a further lambda sensor. This signal is used for a lead control, which is superimposed on the lambda control upstream from the catalytic converter. In general, a jump lambda sensor is used as the lambda sensor downstream from the catalytic converter, which has a very steep characteristic curve at lambda=1 and is therefore able to display lambda=1 with high precision.

In addition to the lead control, which, generally speaking, only corrects minor deviations from lambda=1 and is configured to be comparatively slow, a lambda pilot control may be used, following large deviations from lambda=1, for reaching the catalytic converter window quickly again, e.g., after phases with overrun fuel cutoff ("catalytic converter purging").

Such control concepts have the disadvantage of only detecting a departure from the catalytic converter window at a late stage based on the voltage of the jump lambda sensor downstream from the catalytic converter.

One alternative for controlling the three-way catalytic converter based on the signal of a lambda sensor downstream from the catalytic converter is a control of the mean oxygen fill level of the catalytic converter. Since this mean fill level is not measurable, it may only be modeled. A corresponding model-based control of the fill level of a three-way catalytic converter is described in German Patent Application No. DE 10 2016 222 418 A1. A pilot control for a model-based control of the fill level of a three-way catalytic converter is described in German Patent Application No. DE 10 2018 208 683 A1, and a model-based prediction of the pilot control lambda value required during reactivation following a phase including inactive control intervention is described in German Patent Application No. DE 10 2018 217 307 A1.

SUMMARY

According to the present invention, a method for ascertaining fill levels of a first exhaust gas catalytic converter and of a second exhaust gas catalytic converter as well as a processing unit and a computer program for carrying out the method, are provided. Advantageous embodiments of the present invention are disclosed herein.

A method according to an example embodiment of the present invention for ascertaining fill levels of a first exhaust gas catalytic converter and of a second exhaust gas catalytic converter, which is situated downstream from the first exhaust gas catalytic converter, in an exhaust gas system downstream from an internal combustion engine with respect to at least one exhaust gas component includes detecting, with the aid of a sensor upstream from the first exhaust gas catalytic converter, at least one operating parameter of the exhaust gas system, ascertaining the fill level of the first exhaust gas catalytic converter based on the detected at least one operating parameter with the aid of a first calculation rule, ascertaining a total fill level of the first and second exhaust gas catalytic converters based on the ascertained at least one operating parameter with the aid of a second calculation rule, and ascertaining the fill level of the second exhaust gas catalytic converter as a difference between the total fill level and the fill level of the first exhaust gas catalytic converter. On the one hand, this offers the advantage that the fill levels of both catalytic converters may be ascertained based on a sensor signal, and, on the other hand, it is possible to use comparatively simple models for ascertaining the fill levels since no suitable output signal of the first catalytic converter is required for ascertaining the fill level of the second catalytic converter. Furthermore, the otherwise customary problem of the time offset of signals upstream and downstream from the first catalytic converter is dispensed with, which also entails a significant reduction of the computing time.

Advantageously, according to an example embodiment of the present invention, the at least one operating parameter encompasses a lambda value or an amount of substance of the at least one exhaust gas component. As a result, particularly relevant parameters are available for ascertaining the fill level of the catalytic converters.

In particular, according to an example embodiment of the present invention, the first and the second calculation rule may each encompass an integrator model. This is a particularly simple and robust method for ascertaining the fill level.

In particular, according to an example embodiment of the present invention, the ascertained operating parameter may be integrated over the time within the scope of such an integrator model to obtain the fill level. Depending on the specific selection of the operating parameter, the operating parameter may also be allocated with other variables prior to the integration. For example, a concentration value may be allocated with a volume or a total mass to arrive at a transported substance quantity or mass, which may then be stored in the catalytic converter. A concentration value per se, in contrast, does not provide any information about the stored quantity since the dynamics would remain unconsidered in such a case, and the result of the integration would also increase steadily in the case of a, for example, stationary exhaust gas for a concentration different from zero.

Advantageously, according to an example embodiment of the present invention, the first and the second calculation rule each take a present exhaust gas temperature and/or a maximum storage capacity of the first exhaust gas catalytic converter, or of the two exhaust gas catalytic converters, and/or an aging parameter into consideration. In particular, for example at a high temperature, an integration speed may be increased and/or an upper integration limit (e.g., maximum fill level) may be adapted as a function of the temperature. In this way, the precision of the fill level ascertainment may be significantly enhanced since these parameters have a significant influence on both the thermodynamic equilibrium situation and the kinetics of the storage of exhaust gas components.

In particular, according to an example embodiment of the present invention, the at least one exhaust gas component encompasses oxygen and/or nitrogen oxides and/or fat gas components, in particular, one or multiple components made up of hydrocarbons and ammonia. These are particularly relevant exhaust gas components which, on the one hand, may be stored well in corresponding catalytic converters and the content of which in the exhaust gas, on the other hand, may also be determined relatively easily.

According to an example embodiment of the present invention, the method furthermore preferably includes ascertaining an output operating parameter of the exhaust gas system downstream from the second exhaust gas catalytic converter, using an output sensor, and correcting the first and/or second calculation rule(s) based on the output operating parameter. In this way, the calculation rule may be adapted when the output operating parameter shows that this calculation rule does not map the real catalytic converter behavior with sufficient accuracy.

According to an example embodiment of the present invention, in the process, the output operating parameter may preferably encompass at least one lambda value and/or an amount of substance of an exhaust gas component and/or a concentration of an exhaust gas component. These are variables which may be determined relatively easily and, at the same time, are particularly relevant, as was already stated.

A processing unit according to the present invention, e.g., a control unit of a motor vehicle, is configured, in particular from a programming point of view, to carry out a method according to the present invention.

In addition, the implementation of a method according to the present invention in the form of a computer program or a computer program product having program code for carrying out all method steps is advantageous since this incurs particularly low costs, in particular when an executing control unit is also used for additional tasks and is therefore present anyhow. Finally, a machine-readable memory medium is provided, including a computer program as described above stored thereon. Suitable memory media or data media for providing the computer program are, in particular, magnetic, optical and electrical memories, such as hard disks, flash memories, EEPROMs, DVDs, and the like. It is also possible to download a program via computer networks (Internet, Intranet, and the like). Such a download may take place via a hard-wired or cable connection, or wirelessly (e.g., via a WLAN network, a 3G, 4G, 5G or 6G connection, etc.).

Further advantages and embodiments of the present invention are derived from the description and the figures.

The present invention is schematically shown based on one exemplary embodiment in the figures and is described hereafter with reference to the figures.

DETAILED DESCRIPTION OF EXAMPLE EMBODIMENTS

Figure 1:
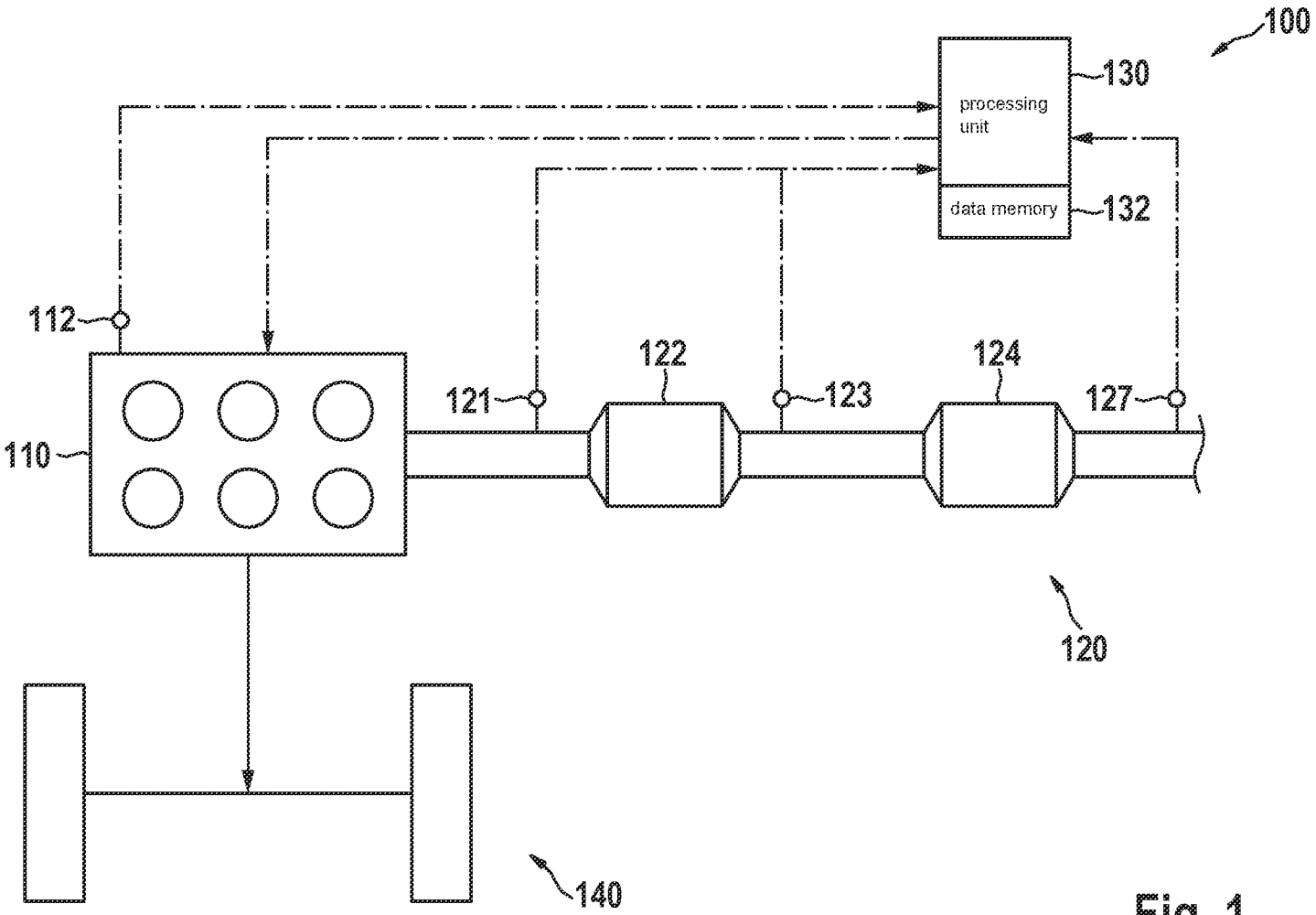
FIG. 1 shows a schematic illustration of a vehicle including an internal combustion engine and an exhaust gas system in which advantageous embodiments of the present invention may be used.

FIG. 1 schematically shows a vehicle, as it may be used within the scope of embodiments of the present invention, which is denoted overall by reference numeral 100.

Vehicle 100 includes an internal combustion engine 110, here, for example, including six indicated cylinders, an exhaust gas system 120, which includes a first catalytic converter 122 and a second catalytic converter 124, as well as a processing unit 130, which is configured to control internal combustion engine 110 and exhaust gas system 120 and is connected thereto in a data-conducting manner. Furthermore, processing unit 130 is connected to sensors 121, 127 in a data-conducting manner in the illustrated example, which detect operating parameters of internal combustion engine 110 and/or of exhaust gas system 120. It shall be understood that further sensors may be present, which are not shown. Exhaust gas system 120 may possibly also include further purification components, such as, for example, particulate filters and/or further catalytic converters, which, however, are not shown here for the sake of simplicity.

In the illustrated example, processing unit 130 includes a data memory 132 in which, for example, calculation rules and/or parameters (e.g., threshold values, characteristics of internal combustion engine 110 and/or of exhaust gas system 120 or the like) may be stored.

Internal combustion engine 110 drives wheels 140 and, in certain operating phases, may also be driven by the wheels (e.g., so-called coasting mode).

One example embodiment of the present invention is described hereafter based on the example of an exhaust gas system 120, which, in the flow direction, includes a broadband lambda sensor 121, a first three-way catalytic converter 122, a jump lambda sensor 123, a second three-way catalytic converter 124, and a $NO_x$ sensor 127. However, the present invention may also be applied accordingly to other exhaust gas systems.

Figure 2:
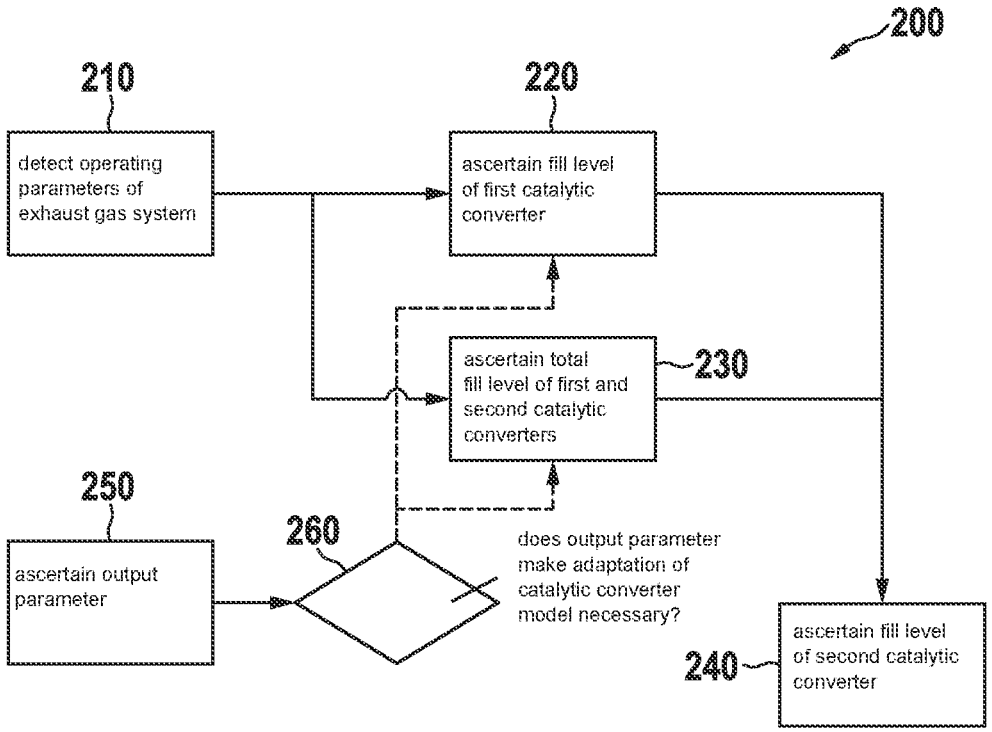
FIG. 2 shows a simplified block diagram of an advantageous example embodiment of the present invention.

FIG. 2 schematically shows one advantageous example embodiment of the present invention based on the example of a method in the form of a block diagram which is denoted overall by reference numeral 200.

The method starts with a first step 210, in which an operating parameter of exhaust gas system 120 is detected, using sensor 121 upstream from first catalytic converter 122. In the example shown here, sensor 121 is a broadband lambda sensor, and the operating parameter is at least one lambda value. It shall be understood that it is also possible to detect other and/or further sensor signals and utilize them within the scope of method 200.

Based on the lambda value ascertained in the first step, a fill level of first catalytic converter 122 is ascertained in a subsequent step 220. A first calculation rule is used for this purpose, for example a simple integrator model of catalytic converter 122, which may be stored in memory 132 of processing unit 130 of vehicle 100.

An integrator shall serve as an example of a very simple model of catalytic converter 122, which integrates the oxygen or fat gas mass flow flowing into catalytic converter 122. The integrator consequently maps the oxygen stored in catalytic converter 122, and thus the oxygen fill level of catalytic converter 122. The oxygen mass flow may be calculated in a simple manner from the exhaust gas lambda and the air mass flow upstream from catalytic converter 122. In the example explained here, the exhaust gas lambda is available as a measured variable of broadband lambda sensor 121 upstream from first catalytic converter 122, while the oxygen mass flow is generally a model variable.

The speed with which the real catalytic converter 122 is being filled or emptied not only depends on the exhaust gas lambda and on the exhaust gas mass flow, but is, e.g., also dependent on the temperature of catalytic converter 122 and its relative fill level. The fill level of a hotter catalytic converter 122 may change more quickly than that of a colder catalytic converter 122, and the fill level will change less quickly when catalytic converter 122 is already largely filled or emptied. In addition, catalytic converter 122 has a temperature-dependent maximum oxygen storage capacity which cannot be exceeded. These additional dependencies are moreover dependent on the aging of catalytic converter 122. The simplification should not go so far as to neglect these dependencies since then a sufficiently precise description of the oxygen fill level of the real catalytic converter 122 would no longer exist. In the example of the integrator, e.g., the integration speed and the integration limits are therefore provided with corresponding dependencies, which are preferably mapped via applicable characteristic curves or characteristic maps.

A three-way catalytic converter is only able to completely convert the inflowing oxygen or fat gas mass flow in a narrow average range of the oxygen fill level, namely in the so-called catalytic converter window. At higher or lower relative oxygen fill levels, the conversion is no longer complete. Oxygen or fat gas slip then occurs from first catalytic converter 122 into second catalytic converter 124. To take this effect into consideration, the oxygen or fat gas mass flow flowing into first catalytic converter 122 or, alternatively, the oxygen fill level is provided with a correction, which is preferably dependent on the ratio of the present oxygen fill level to the maximum oxygen storage capacity of first catalytic converter 122, and dependent on the type of the inflowing mass flow (oxygen or fat gas). In this way, the oxygen fill level of first catalytic converter 122 may be calculated.

Furthermore, in a step 230, a total fill level of first and second catalytic converters 122, 124 is ascertained based on the same operating parameter (lambda value). For this purpose, a second calculation rule is used, for example also an integrator model, which takes the combined storage capacity of first and second catalytic converters 122, 124 into consideration. This second calculation rule may also be stored in memory 132 of processing unit 130.

A second integrator model, with which the total fill level of first catalytic converter 122 and second catalytic converter 124 is modeled similarly to the model for first catalytic converter 122, may be used without needing a suitable input value for a model of second catalytic converter 124. The oxygen or fat gas mass flow flowing into first catalytic converter 122 is also integrated here. The sum of the maximum oxygen storage capacities of the two catalytic converters 122, 124 establishes the upper integrator limit of the second integrator. An oxygen or fat gas slip of second catalytic converter 124 is also preferably taken into consideration here. In this case, however, the slip of first catalytic converter 122 is not again taken into consideration since this is the modeling of the total fill level of first catalytic converter 122 and second catalytic converter 124. The second integrator consequently maps the sum of the oxygen stored in both catalytic converters 122, 124. The oxygen mass flow flowing into the second integrator may also be calculated here from the exhaust gas lambda and the air mass flow upstream from first catalytic converter 122.

Thereupon, in a step 240, a fill level of second catalytic converter 124 is ascertained from the two fill levels ascertained in steps 220, 230 by subtracting the fill level of first catalytic converter 122 from the total fill level.

The oxygen fill level of the second catalytic converter thus simply results from a subtraction of the fill level of first catalytic converter 122 from the total fill level of first and second catalytic converters 122, 124.

As a result, the oxygen fill levels of both catalytic converters 122, 124 are available for a control, without the fill level of second catalytic converter 124 being distorted by inaccuracies of the signal of exhaust gas sensor 123 upstream from second catalytic converter 124 or by the delayed response of exhaust gas sensor 127 downstream from second catalytic converter 124.

In other words, a balancing of the fill level of first catalytic converter 122 and a balancing of the total fill level of first catalytic converter 122 and second catalytic converter 124 occur in each case based on the signal of lambda sensor 121 upstream from first catalytic converter 122. The fill level of second catalytic converter 124 then results from the difference of the total fill level and the fill level of first catalytic converter 122.

In this way, a model-based balancing of the fill levels of two consecutively situated catalytic converters 122, 124 is made possible, using catalytic converter models which are as simple as possible. In the process, both the fill level of first catalytic converter 122 and the fill level of second catalytic converter 124 situated downstream therefrom are modeled based on the signal of a lambda sensor 121 upstream from first catalytic converter 122 to avoid inaccuracies in the detection of the fill level of second catalytic converter 124 as a result of being based on exhaust gas sensors upstream or downstream from second catalytic converter 124.

This type of balancing allows very simple catalytic converter models to be used that are not able to provide a suitable state variable that may be used as an input signal for the modeling of the subsequent (second) catalytic converter 124. In particular, the catalytic converters may be described with the aid of a very simple integrator model. A complex modeling of catalytic converters 122, 124 with the aid of a reaction-kinetic model is not necessary.

An exhaust gas sensor 127 downstream from the respective catalytic converter 122, 124 may be used for the discontinuous adaptation of the corresponding modeled fill level. If exhaust gas sensor 123, 127 downstream from a catalytic converter 122, 124, under suitable operating conditions, unambiguously indicates a low or a high lambda, the lambda value correlates with the present fill level of the particular catalytic converter 122, 124. In this case, catalytic converter 122, 124 is freed of oxygen to such an extent, or filled with oxygen to such an extent, that rich or lean exhaust gas breaks through. This correlation may be used for the comparison of the modeled fill levels to the sensor signals. Inaccuracies during the modeling may thus be compensated. For this purpose, an output parameter of the particular catalytic converter 122, 124 is ascertained in a step 250, for example an exhaust gas lambda value or a concentration of a certain exhaust gas component, for example of nitrogen oxides. For this purpose, the respective sensor 123, 127 situated downstream from the particular catalytic converter 122, 124 may be used.

In a step 260, it is decided whether the output parameter ascertained in step 250 makes an adaptation of the catalytic converter model appear necessary. For example, when a predeterminable threshold value is exceeded, the model used in each case in step 220 or 230 may be adapted in such a way that it subsequently maps the real exhaust system 120 (again) with sufficient precision. In this way, it is possible, for example, to compensate for aging or also accumulated inaccuracies resulting from the continuous integration.

The actual balancing of the two catalytic converters 122, 124, however, is based on the signal of a lambda sensor 121 upstream from first catalytic converter 122. Inaccuracies during the balancing of second catalytic converter 124 as a consequence of a distortion of the signal of exhaust gas sensor 123 upstream from second catalytic converter 124 as well as due to the delayed response of exhaust gas sensor 127 downstream from second catalytic converter 124 are thus avoided.

Method 200 thus allows a precise detection of the fill levels of two consecutively situated catalytic converters 122, 124 in a simple manner and, in particular, may be used to improve the control concepts described in the related art to the effect that also the emission behavior with respect to NH 3 is minimized.

What is claimed is:

1. A method for ascertaining a fill level of a first exhaust gas catalytic converter and a fill level of a second exhaust gas catalytic converter, which is situated downstream from the first exhaust gas catalytic converter, in an exhaust gas system downstream from an internal combustion engine with respect to at least one exhaust gas component, the method comprising:

detecting, using a sensor upstream from the first exhaust gas catalytic converter, at least one operating parameter of the exhaust gas system;

ascertaining the fill level of the first exhaust gas catalytic converter based on the detected at least one operating parameter using a first calculation rule;

ascertaining a total fill level of the first exhaust gas catalytic converter and second exhaust gas catalytic converter based on the ascertained at least one operating parameter using a second calculation rule, wherein ascertaining the fill level of the first exhaust gas catalytic converter and ascertaining the total fill level are both based only on the at least one operating parameter detected by the sensor upstream from the first exhaust gas catalytic converter and to the exclusion of any operating parameter obtained from a sensor downstream of the first exhaust gas catalytic converter;

ascertaining the fill level of the second exhaust gas catalytic converter as a difference between the total fill level and the fill level of the first exhaust gas catalytic converter, wherein each of the first calculation rule and the second calculation rule includes an integrator model, which integrates the at least one detected operating parameter over the time; and controlling a physical operation of the exhaust gas system based on at least one of the fill level of the first exhaust gas catalytic converter and the fill level of the second exhaust gas catalytic converter.

2. The method as recited in claim 1, wherein the at least one operating parameter includes a lambda value or an amount of substance of the at least one exhaust gas component.

3. The method as recited in claim 1, wherein the integrator model takes an exhaust gas temperature and/or a maximum storage capacity of the first catalytic converter and second catalytic converter with respect to the at least one exhaust gas component into consideration during a determination of an integration speed and/or during a determination of an upper integration limit.

4. The method as recited in claim 1, wherein each of the first calculation rule and the second calculation rule take into consideration: a present exhaust gas temperature and/or a maximum storage capacity of the first exhaust gas catalytic converter, or of the first and second exhaust gas catalytic converters, and/or an aging parameter.

5. The method as recited in claim 1, wherein the at least one exhaust gas component includes oxygen and/or nitrogen oxides and/or fat gas components including one or multiple components made up of hydrocarbons and ammonia.

6. A processing unit configured to ascertain a fill level of a first exhaust gas catalytic converter, and a fill level of a second exhaust gas catalytic converter which is situated downstream from the first exhaust gas catalytic converter, in an exhaust gas system downstream from an internal combustion engine with respect to at least one exhaust gas component, the processing unit configured to:

detect, using a sensor upstream from the first exhaust gas catalytic converter, at least one operating parameter of the exhaust gas system;

ascertain the fill level of the first exhaust gas catalytic converter based on the detected at least one operating parameter using a first calculation rule;

ascertain a total fill level of the first exhaust gas catalytic converter and second exhaust gas catalytic converter based on the ascertained at least one operating parameter using a second calculation rule, wherein the fill level of the first exhaust gas catalytic converter and the total fill level are both ascertained based on the at least one operating parameter detected by the sensor upstream from the first exhaust gas catalytic converter and to the exclusion of any operating parameter obtained from a sensor downstream of the first exhaust gas catalytic converter;

ascertain the fill level of the second exhaust gas catalytic converter as a difference between the total fill level and the fill level of the first exhaust gas catalytic converter, wherein each of the first calculation rule and the second calculation rule includes an integrator model, which integrates the at least one detected operating parameter over the time; and control a physical operation of the exhaust gas system based on at least one of the fill level of the first exhaust gas catalytic converter and the fill level of the second exhaust gas catalytic converter.

7. A non-transitory machine-readable memory medium on which is stored a computer program for ascertaining a fill level of a first exhaust gas catalytic converter, and a fill level of a second exhaust gas catalytic converter which is situated downstream from the first exhaust gas catalytic converter, in an exhaust gas system downstream from an internal combustion engine with respect to at least one exhaust gas component, the computer program, when executed by a processing unit, causing the processing unit to perform the following steps:

detecting, using a sensor upstream from the first exhaust gas catalytic converter, at least one operating parameter of the exhaust gas system;

ascertaining the fill level of the first exhaust gas catalytic converter based on the detected at least one operating parameter using a first calculation rule;

ascertaining a total fill level of the first exhaust gas catalytic converter and second exhaust gas catalytic converter based on the ascertained at least one operating parameter using a second calculation rule, wherein ascertaining the fill level of the first exhaust gas catalytic converter and ascertaining the total fill level are both based on the at least one operating parameter detected by the sensor upstream from the first exhaust gas catalytic converter and to the exclusion of any operating parameter obtained from a sensor downstream of the first exhaust gas catalytic converter;

ascertaining the fill level of the second exhaust gas catalytic converter as a difference between the total fill level and the fill level of the first exhaust gas catalytic converter, wherein each of the first calculation rule and the second calculation rule includes an integrator model, which integrates the at least one detected operating parameter over the time; and controlling a physical operation of the exhaust gas system based on at least one of the fill level of the first exhaust gas catalytic converter and the fill level of the second exhaust gas catalytic converter.

* * * * *